US005853168A

United States Patent [19]

Drake

[11] Patent Number: 5,853,168

[45] Date of Patent: Dec. 29, 1998

[54] BAR CLAMP FOR SINGLE-HAND OPERATION

[76] Inventor: Johannes Drake, Am Richterbusch 18, 33106 Paderborn, Germany

[21] Appl. No.: 805,448

[22] Filed: Feb. 25, 1997

[30] Foreign Application Priority Data

Mar. 1, 1996 [DE] Germany ..... 296 03 811 U

[51] Int. Cl.[6] ..... B25B 5/02

[52] U.S. Cl. ..... 269/6; 269/170

[58] Field of Search ..... 254/3, 6, 166, 254/169, 168, 203, 204; 81/987

[56] References Cited

U.S. PATENT DOCUMENTS

| | | | |
|---|---|---|---|
| 4,874,155 | 10/1989 | Ashley . | |
| 4,893,801 | 1/1990 | Flinn . | |
| 4,926,722 | 5/1990 | Sorensen et al. | 81/487 |
| 5,009,134 | 4/1991 | Sorensen et al. | 81/487 |
| 5,094,131 | 3/1992 | Sorensen et al. | 81/487 |
| 5,454,551 | 10/1995 | Hobday . | |

FOREIGN PATENT DOCUMENTS

| | | |
|---|---|---|
| 77 07575 | 3/1977 | France . |
| 1 181 645 | 9/1959 | Germany . |
| 30 43 606 C2 | 11/1980 | Germany . |
| 39 17 473.5 | 5/1989 | Germany . |
| 89 15 949.7 | 5/1989 | Germany . |
| 40 28 274.0 | 9/1990 | Germany . |
| 41 04 563.7 | 2/1991 | Germany . |
| 1 450 092 | 3/1974 | United Kingdom . |
| 1 486 309 | 12/1975 | United Kingdom . |

*Primary Examiner*—Robert C. Watson
*Attorney, Agent, or Firm*—Henry M. Feiereisen

[57] ABSTRACT

A bar clamp for single hand operation; includes a housing, a fixed jaw and a movable jaw mounted on one end of a slide bar for movement in a direction toward the fixed jaw. A spring-loaded driving key is secured on the slide bar and through operation of a trigger handle engages the slide bar for advancing the movable jaw toward the fixed jaw. A locking key is biased against the slide bar and normally engaged with the slide bar to prevent motion of the second jaw away from the first jaw and actuatable to disengage from the slide bar to allow advancement of the second jaw away from the first jaw. The trigger handle has one end pivotably mounted within the housing and formed with two lateral mounting plates of arched outer configuration. The housing is comprised of a first housing portion and a second housing portion, with at least the driving key and the locking key being accommodated within the housing. The first housing portion has formed on an inside wall thereof a first support member for surrounding one of the mounting plates, and the second housing portion includes a second support member formed on an inside wall of the second housing portion for receiving the other one of the mounting plates.

19 Claims, 2 Drawing Sheets

BAR CLAMP FOR SINGLE-HAND OPERATION

BACKGROUND OF THE INVENTION

The present invention refers generally to a bar clamp, and in particular to a bar clamp of a type having a stationary jaw and a movable jaw mounted on one end of a slide bar which is movable to bring the movable jaw in direction of the stationary bar.

A bar clamp of this type is typically used e.g. by a homeworker to temporarily clamp together two articles or to hold a workpiece for subsequent treatment. The bar clamp includes a spring-biased driving key mounted on the slide bar and a spring-biased locking key which is formed with a release lever, with the driving key being movable through actuation of a trigger handle. Such a bar clamp allows operation with one hand while the other hand can be used to hold the workpieces to be clamped or worked on. The slide bar is normally configured as flat bar, with the driving key being formed with a slot for passage of the slide bar. The height of the slot is slightly greater than the width or height of the slide bar so that the slide bar is capable of traveling when the actuation of the trigger handle forces the driving key into a slanted position. In the normal standby position, the driving key is oriented vertical or nearly vertical upon the longitudinal axis of the slide bar, and the jaws are secured in place by the locking key which is slightly inclined in relation to the vertical upon the longitudinal axis of the slide bar. Actuation of the release lever in opposition to the spring force tilts the locking key into a position perpendicular to the longitudinal axis of the slide bar which then can travel unimpeded to release the clamping action upon the workpieces. Round steel or square bar steel may be used instead of the flat bar when suitably matching the slot of the driving key and the locking key.

Conventional bar clamps are characterized by a great number of individual components and exhibit relatively great outer dimensions. This is a problem especially for homeworkers. Moreover, conventional bar clamps require cumbersome assembly works so that the mass production of such items is adversely affected. Also the areas for transmitting the forces is relatively small so that the contact pressure between the slide bar, on the one hand, and the trigger handle and also the locking key is substantial.

SUMMARY OF THE INVENTION

It is an object of the present invention to provide an improved bar clamp, obviating the afore-stated drawbacks.

In particular, it is an object of the present invention to provide an improved bar clamp which is easy to design so as to simplify its assembly and has a reduced number of components while yet being reliable in operation.

These objects and others which will become apparent hereinafter are attained in accordance with the present invention by providing a housing for accommodating at least the driving key and the locking key, with the housing being of two-part configuration with a first housing portion and a second housing portion, and by forming an upper end of the trigger handle within the housing with two lateral mounting plates of arched outer configuration, whereby the first housing portion is formed on the inside wall surface thereof with a bearing shell and/or bearing bore for receiving one of the mounting plates of the trigger handle and thereby guiding the trigger handle, and whereby the second housing portion, e.g. a cover, is formed on the inside wall with a support element for receiving the other one of the mounting plates of the trigger handle.

A bar clamp according to the present invention is characterized by a minimum of individual parts. Thus, assembly become greatly facilitated. Especially the provision of a bearing shell to support the respective mounting plate of the trigger handle simplifies the assembly because the still open first housing part allows insertion of the respective end section of the trigger handle, after mounting the other individual components in the housing. Subsequently, the second housing part, e.g. the cover, can be connected to the first housing part. This connection between the two housing portions can be detachable or permanent. A detachable connection can be effected e.g. by a screwed connection, or preferably by a snap-on connection that is less time consuming. A permanent connection is effected through welding or gluing or a connection by one or more hinges. After attaching the second housing portion to the first housing portion, the trigger handle is supported on both sides. The support element should be so dimensioned that the trigger handle is prevented from falling out through the required opening formed on the bottom side of the housing to allow passage of the trigger handle outwards because normally the slide bar with the attached jaw is inserted through the respective slots only after receiving a respective customer order. The separation of the slide bar from the housing facilitates the interim storage of the pre-assembled housing and allows the manufacturer to best suit the length of the slide bar to customer's specifications. It is certainly also possible for the customer to finish the assembly of the bar clamp at the customer's end. The bearing bore formed in the second housing portion or cover for the associated mounting plate is normally disposed centrally in order to allow a swinging motion of the trigger handle. In a most simple manner, the support element is a pivot pin which engages a bore of the associated mounting plate.

In order to prevent a canting of the trigger handle when being squeezed, the second housing portion is additionally formed with a bearing shell which complements the outer contour of the associated mounting plate of the trigger handle so that this mounting plate is supported from inside as well as outside.

A bar clamp according to the present invention is characterized by an advantageous disposition of the individual components as far as a force distribution is concerned because the components are accommodated within the interior area of the housing. The first housing portion is suitably provided with the bearing shell on its side wall so that the second housing portion forms the complementary parallel and spaced side wall which may constitute the cover. In this case, the housing of the bar clamp assumes a generally box-shaped configuration.

Preferably, the trigger handle is formed inside the housing with an opening adjacent the mounting pates for passage of the driving key, with a transverse edge bounding the opening and bearing behind a facing edge area of the driving key. In this manner, actuation of the driving key by the trigger handle is effected in a most simple manner, by squeezing the trigger handle to cause the driving key to move into a slanted position and thereby advance the slide bar. Suitably, the trigger handle has a U shaped cross section to exhibit sufficient stability. In the event, the trigger handle is made of metal, the trigger handle can be made through cold forming from a suitable blank.

According to another feature of the present invention, the driving key is formed of two adjoining key plates with aligned slots that are suited to the cross section of the slide bar. Likewise, the locking key is formed of two locking key plates with aligned slots that are suited to the cross section of the slide bar. In this manner, two surfaces are respectively formed by which the load to be applied is transmitted evenly so that the contact pressure is comparably small, e.g. only half compared to conventional bar clamps. The width of each mounting plate of the trigger handle should be so dimensioned as to allow production of the components of the trigger handle of metal, e.g. steel, through a punching process.

Preferably, the housing of the bar clamp is made of plastic material through injection molding. Thus, tolerances may be experienced. Moreover, also the production of the locking key is subject to certain tolerances. In order to ensure that the locking key is snugly fitted in a seat while still being capable of executing the required motion, it is preferred to design the locking key with one end extending out of the housing to form a release lever, and another end which bears with one side upon a fixed abutment and on the other side upon an elastically deformable web for urging the locking key onto the fixed abutment. Thus, while the locking key is snugly fitted in a seat, actuation of the release lever still permits a movement of the locking key. In order to facilitate actuation of the release lever, the housing is formed with an engagement member projecting outwardly from the housing at a distance to the release lever, with the web being positioned at a side facing the engagement member. Preferably, the engagement member is fixedly secured to the housing and forms the counterpiece to the release lever so that the release lever can be pushed with one finger of the hand while the thumb is supported by the engagement member. In order to prevent the release lever and the engagement member from interfering with an actuation of the trigger handle, the release lever and the engagement member are positioned at the side of the housing in opposition to the trigger handle.

According to another feature of the present invention, the driving key and the locking key are formed at least on one longitudinal side with a lateral, open recess for engagement of a fixed catch projecting inwardly from a side wall of the first housing portion and/or second housing portion. In this manner, the driving key and the locking key are easy to secure and easy to assemble. Preferably, the recesses are positioned in the upper area opposite to the trigger handle. Suitably, the catch is disposed on the inside of the first housing portion because the individual components are first inserted in this housing portion, before being closed by the second housing portion, e.g. the cover. The recesses may be of any suitable configuration, e.g. of semicircular shape.

A particularly long-lasting and easy to make connection between the slide bar and the attached movable jaw carrier is effected by providing an interlocking connection and/or an interference fit. In order to effect the interlocking joint and/or interference fit of the slide bar with the jaw carrier, the slide bar is formed with a bore, with the jaw carrier being provided with a detent for engagement in the bore. In this manner, the jaw carrier is sufficiently secured in place in the standby or unloaded condition. In loaded position, a moment is transmitted that prevents a shift of the jaw carrier. Preferably, the jaw carrier is formed with two detents for engagement of the bore from both sides.

According to another feature of the present invention, at least one of the jaws of the fixed and movable jaw carriers is supported by a resilient web so as to effect a full contact of the jaws upon a workpiece being clamped as a result of the mobility of the respective jaw. The web thus has the effect of a hinge.

In order to minimize the outer dimensions of the bar clamp, both jaws and both jaw carriers are positioned on the side facing the trigger handle. Suitably, the first housing portion with the handgrip and the jaw carrier near the trigger handle is formed as a single-piece molded part. The bar clamp is then so dimensioned that operation of the trigger handle causes a movement of the movable jaw carrier and the supported jaw in direction toward the fixed jaw.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
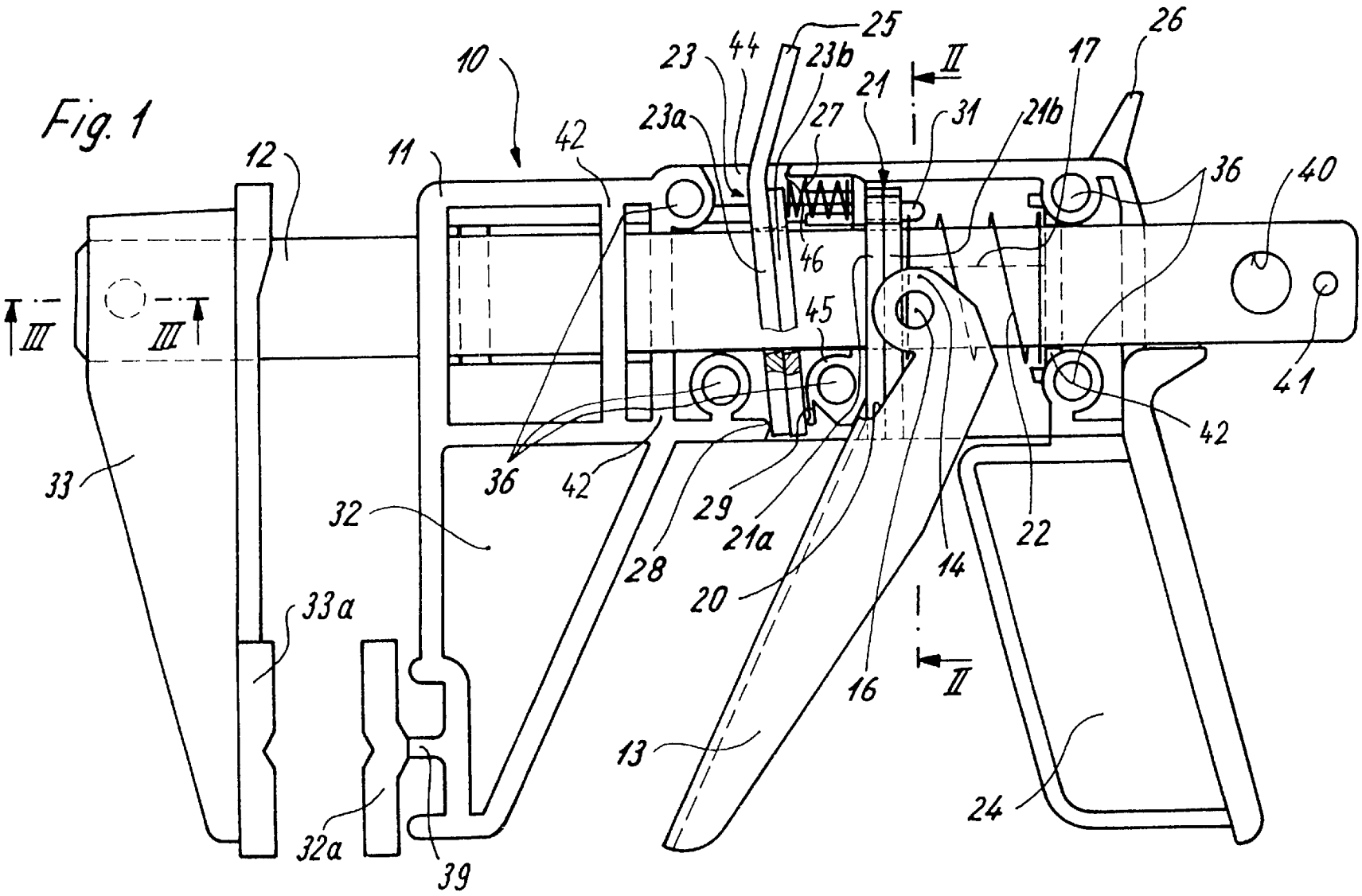
FIG. 1 is a side elevational view of a bar clamp in accordance with the present invention, with the cover being removed to illustrate the various components and their arrangement in the first housing portion.

Throughout all the FIGS., the same or corresponding elements are always indicated by the same reference numerals.

Turning now to the drawing, and in particular to FIG. 1, there is shown a side elevational view of a bar clamp in accordance with the present invention, generally designated by reference numeral 10 and including a housing having a first housing portion 11 of generally U shaped or box-shaped configuration and made of plastics through injection molding. The housing portion 11 is stabilized by respective reinforcement ribs 42 and formed in longitudinal direction with several aligned, tetragonal slots for passage of a slide bar 12 which is configured in the nonlimiting example of FIG. 1 in the form of a flat bar. At the rear end thereof, the housing portion 11 is formed with a handgrip 24 while the front end of the housing portion 11 carries a fixed jaw carrier 32 for a jaw 32*a*. Thus, the housing portion 11 forms with the handgrip 24 and the jaw carrier 32 a single-piece molded part. Mounted to the front end of the slide bar 12 is a movable jaw carrier 33 for a movable jaw 33*a*. Suitably, the jaw 32*a* is connected to the jaw carrier 32 via a resilient web 39 to ensure a slight mobility within constraints of the jaw 32*a* and thereby ensure a close, flat contact of both jaws 32*a*, 33*a* upon the workpiece being clamped.

Figure 4:
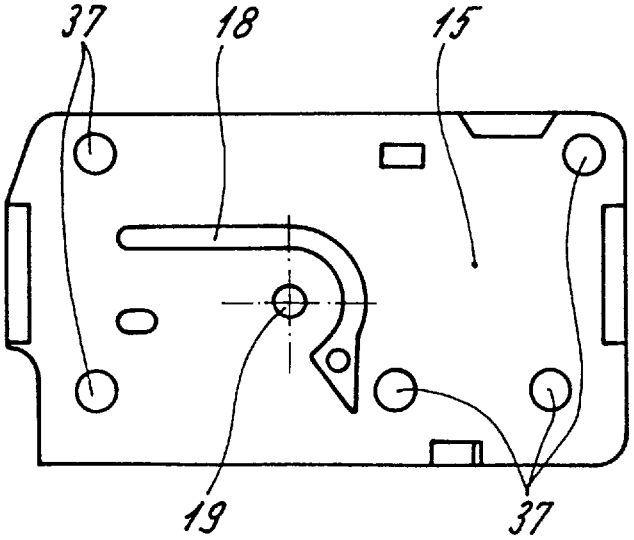
FIG. 4 is a plan view upon the inner surface of the cover for closing the first housing portion.
Figure 2:
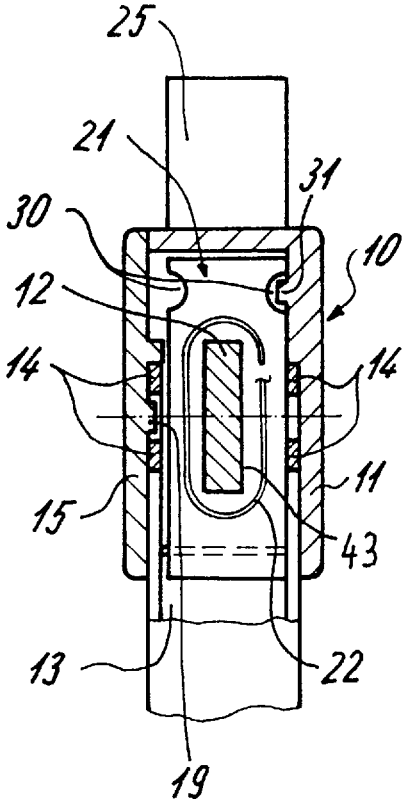
FIG. 2 is a sectional view of the bar clamp taken along the line II—II in FIG. 1.

A single-piece trigger handle 13 of metal has an upper end which is forked and pivotably mounted within the housing portion 11. This upper end of the trigger handle 13 is formed with two mounting plates 14 (only one is shown in FIG. 1) which are positioned in parallel relationship at a distance to each other, as best seen in FIG. 2, and exhibit an outer contour of substantially semicircular configuration. Both mounting plates 14 respectively bear upon inside surfaces of the housing portion 11 and of a second housing portion which forms a cover 15 (FIG. 4) for closing the housing portion 11. At least the mounting plate 14 that is received by the cover 15 is formed with a central bore 16. The support of the trigger handle 13 is effected at the inside of the side wall of the housing portion 11 by a guideway 17 that forms a bearing shell exhibiting an outline complementing the outer contour of the mounting plate 14. A substantially similar guideway 18 (FIG. 4) is formed on the inside of the cover 15 for guiding the other mounting plate 14 by the thus-formed bearing shell. Positioned in the center of curvature of the guideway 18 is a pivot pin 19 which projects inwardly from the inside of the cover 15 and engages the bore 16 of the pertaining mounting plate 14.

It will be appreciated by persons skilled in the art that the guideways 17, 18 may project inwardly from the inside surface of the housing part 11, and cover 15, or may also be formed by respective grooves.

The trigger handle 13 exhibits a U shaped cross section, with the open side facing the handgrip 24, and is formed with an opening 20 which is positioned inside the housing portion 11. Projecting into the opening 20 is a driving key 21 which is suspended on the slide bar 14 and is formed in the nonlimiting example of FIG. 1 by two identical key plates 21*a*, 21*b* in contiguous disposition. A spring 22 is suited to the cross section of the slide bar 12 and compressed between the driving key 21 and a surface of the reinforcing rib 42 to load the driving key 21 against the upper end of the trigger handle 13 toward a standby position. In this standby position, the driving key 21 is positioned perpendicular to the longitudinal axis defined by the slide bar 12, whereby the driving key 21 is formed with a tetragonal slot 43 of a height that is slightly greater than the width or height of the slide bar 12.

The bar clamp 10 further includes a locking key 23 which is secured on the slide bar 12 at a distance to the driving key 21 which, in the non-limiting example of FIG.1, is positioned offset relative to the trigger handle 13 at the side distant to the handgrip 24. The locking key 23 is formed with a tetragonal slot for passage of the slide bar 12 and is formed of two key plates 23*a*, 23*b* in contiguous disposition. The key plate 23*a* which is positioned distant to the trigger handle 12 is so extended outwardly in relation to the key plate 23*b* that proximates the trigger handle 13 as to form a release lever 25. The release lever 25 projects outwardly through an opening 44 of the housing portion 11. In order to facilitate operation of the release lever 25, the housing portion 11 is formed on its side opposite to the handgrip 24 with an engagement member 26 that extends outwardly and allows engagement by the thumb of the user's hand when pushing the release lever 25 by a finger of the hand. A spring 27 is compressed between the locking key 23 and an inside surface of the housing portion 11 to load the locking key 23 away from the engagement member 26. The lower end of the locking key 23, opposite to the release lever 25, bears with its key plate 23*a* upon a fixed abutment 28 of the housing portion 11. The abutment 28 is thus positioned at the side of the locking key 23, distant to the trigger handle 13. Acting upon the key plate 23*b* which proximates the trigger handle 13 is an elastically deformable web 29 which projects downwards from a support 45, with the trigger handle 13 resting upon the support 45 in standby position. Thus, the locking key 23 is received in a play-free seat which still allows a pivoting of the locking key 23 within constraints defined by the edge 46 of the opening 44 and by binding the locking key 23 with the surface of the slide bar 12.

The key plates 21*a*, 21*b* of the driving key 21 and the key plates 23*a*, 23*b* of the locking key 23 are received within the housing portion 11 and preferably of same construction. At their ends distant to the trigger handle 13, the key plates 21*a*, 21*b*, 23*a*, 23*b* are formed on their side facing the housing portion 11 with semicircular recesses 30 which are distant to the trigger handle 13 in the nonlimiting example of FIG. 1. In order to secure the key plates 21*a*, 21*b* of the driving key 21 and the key plates 23*a*, 23*b* of the driving key 23, catches 31 project inwardly from the inside wall of the housing portion 11 for engagement into the recesses 30.

Figure 3:
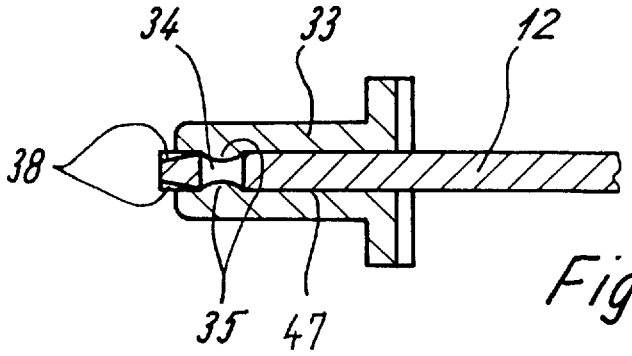
FIG. 3 is a sectional view of the bar clamp taken along the line III—III in FIG. 1.

Turning now to FIG. 3, there is shown a sectional view of the bar clamp 10 in the area of the forward end of the slide bar 12 to illustrate the securement of the respective jaw carrier 33 to the slide bar 12. At its upper end, the jaw carrier 33 is formed with a slot 47 which exhibits a tetragonal cross section of such dimensions as to snugly fit the forward end of the slide bar 12 therein. The flat slide bar 12 is formed with a transverse bore 34 for engagement of detents 35 projecting inwardly from the inside wall of the jaw carrier 33. In this manner, mechanical connecting elements such as rivets are omitted. Suitably, the forward end of the slide bar 12 is formed with ramps 38 to overcome the detents 35 and thus facilitate placement of the jaw carrier 33 upon the slide bar 12.

As shown in FIG. 1, the jaw carriers 32, 33 and their jaws 32*a*, 33*a* are disposed on the same side as the handgrip 24 and the trigger handle 13, i.e. below the slide bar 12. The cover 15 that forms the second housing portion is suitably detachably secured to the housing portion 11, without use of additional mechanical connecting elements, by forming the housing portion 11 with several bores 36 or blind bores on both sides of the slide bar 12. The cover 15 is formed with respective pins which are pushed into the bores 36 by a suitable force depending on the size of the pins. A detachment of the cover 15 can then be effected through a suitable tool.

Persons skilled in the art will understand that the attachment of the cover 15 to the housing portion 11 can be done in a variety of different ways, e.g. through gluing or welding. In this case, access to and replacement of individual components of the bar clamp can be carried out only through destruction of the housing.

Assembly of the bar clamp 11 is carried out in the following manner: The driving key 21, the locking key 23 and the springs 22, 27 are placed into the housing portion 11 that is formed in one piece with the handgrip 24 and the jaw carrier 32. Then, the trigger handle 12 is inserted through a bottom opening of the housing portion 11, with the guideway 17 forming the bearing shell at the inside of the housing portion 11 for effecting a precise positioning of the trigger handle 13. Upon attachment of the cover 15, the pivot pin 19 engages the central bore 16 of the pertaining mounting plate 14. The housing portion 11 closed by the detachable cover 15 can then be stored separately, if need be. In order to complete the bar clamp 10, it is only necessary to push the slide bar 12 with the jaw carrier 33 and jaw 33*a* into the housing formed by the housing portion 11 and the cover 15, whereby the length of the slide bar 12 can be suited to customer's specifications.

Suitably, the slide bar 12 is formed at the rear free end with a bore 40 to allow suspension of the bar clamp 10. A stop member in form of a transverse pin 41 passes through the free end of the slide bar 12 next to the bore 40 to prevent withdrawal of the slide bar 12 from the housing when the locking lever 23 is pressed toward the engagement member 26 to manually draw the movable jaw 33*a* away from the fixed jaw 32*a*.

In the standby position, the driving key 21 is substantially perpendicular to the longitudinal axis of the slide bar 12 while the locking key 23 occupies a slightly tilted disposition to engage the slide bar 12 so as to lock a motion of the movable jaw 33*a* away from the fixed jaw 32*a* while allowing a movement of the slide bar 12 in opposite direction, i.e. a movement of the movable jaw 33*a* toward the fixed jaw 32*a* upon application of a suitable force. This force can be applied by squeezing the trigger handle 23 in direction toward the handgrip 24 to incrementally advance the slide bar 12 with its attached movable jaw 33*a* in direction of the fixed jaw 32*a*. When squeezing the trigger handle 13 between an operator's hand and the handgrip 24, the trigger handle 13 pivots, causing the driving key 21 to pivot in opposition to the spring 27. Thus, the driving key 21 is no longer in vertical disposition but occupies a slightly tilted position so that the driving key 21 engages the slide bar 12. The interference fit between the driving key 21 and the slide bar 12 advances the slide bar 12 and the attached movable jaw 33*a* toward the fixed jaw 32*a*. The incremental advance of the movable jaw 33*a* by one stroke of the trigger handle 13 is limited by the impact of the trigger handle 13 upon the facing surface of the handgrip 20.

After each stroke, a release of the trigger handle 13 returns the trigger handle 13, the driving key 21 and the locking key 23 to the standby position as a consequence of the force exerted by the springs 22, 27.

If clamping of a workpiece is to be terminated, pressing of the release lever 25 in direction to the engagement member 26 causes the locking key 23 to move from the slight tilt relative to the longitudinal axis of the slide bar 12 into a vertical position, so that the interference fit between the locking key 23 and the slide bar 12 is released to allow the movable jaw 33*a* to be moved away from the fixed jaw 32*a* and thereby increase their mutual distance.

Persons skilled in the art will understand that the bearing shell formed on the housing portion 11 by the guideway 17 may certainly be substituted by a different type of bearing element, e.g. a bearing bore.

While the invention has been illustrated and described as embodied in a bar clamp for single-hand operation, it is not intended to be limited to the details shown since various modifications and structural changes may be made without departing in any way from the spirit of the present invention.

What is claimed as new and desired to be protected by Letters Patent is set forth in the appended claims:

1. A bar clamp for single hand operation; comprising:

a housing including of a first housing portion and a second housing portion connectable to the first housing portion;

a slide bar traversing the housing;

a first jaw;

a second jaw connected to one end of the slide bar for movement in a direction toward the first jaw;

advancing means for moving the slide bar and thereby bring the second jaw toward the first jaw, said advancing means including a spring-loaded driving key placed on the slide bar, a spring-loaded locking key normally engaging the slide bar to prevent motion of the second jaw away from the first jaw and actuatable to disengage from the slide bar to allow advancement of the second jaw away from the first jaw, and a trigger handle acting upon the driving key for moving the driving key into engagement with the slide bar, said trigger handle having one end pivotably mounted inside the housing and formed with two lateral mounting plates of arched outer configuration, wherein at least the driving key and the locking key are received within the housing; and bearing means for supporting the mounting plates of the trigger handle, said bearing means including a first support member formed on an inside wall of the first housing portion and surrounding a first one of the mounting plates, and a second support member formed on an inside wall of the second housing portion for receiving a second one of the mounting plates.

2. The bar clamp of claim 1 wherein the first support member is a bearing shell having a contour complementing the outer contour of the first mounting plate.

3. The bar clamp of claim 1 wherein the first support member is a bore having a contour complementing the outer contour of the first mounting plate.

4. The bar clamp of claim 1 wherein the second housing portion is a cover.

5. The bar clamp of claim 2 wherein the bearing means includes in addition to the second support member a third support member in the form of a bearing shell provided on the second housing portion and having a contour complementing the outer contour of the second mounting plate.

6. The bar clamp of claim 5 wherein the bearing shell of the first support member and the bearing shell of the third support member are each formed by a guideway.

7. The bar clamp of claim 1 wherein the trigger handle is formed inside the housing with an opening adjacent said mounting plates for passage of the driving key, with a transverse edge bounding the opening bearing behind a facing edge area of the driving key.

8. The bar clamp of claim 1 wherein the trigger handle has a U shaped cross section and exhibits an open side, and further comprising a handgrip mounted on the first housing portion, with the open side of the trigger handle facing the handgrip.

9. The bar clamp of claim 1 wherein the driving key is formed by two adjoining key plates exhibiting aligned slots of a configuration complementing a cross section of the slide bar.

10. The bar clamp of claim 1 wherein the locking key is formed by two key plates exhibiting aligned slots of a configuration complementing a cross section of the slide bar.

11. The bar clamp of claim 1 wherein the locking key has one end extending out of the housing and forming a release lever, and another end bearing on one side upon a fixed abutment and on the other side upon an elastically deformable web by which the locking key is urged against the fixed abutment.

12. The bar clamp of claim 11 wherein the first housing portion is formed with a fixed engagement member projecting outwardly from the first housing portion at a distance to the release lever, with the web being positioned at a side of the locking key facing the engagement member.

13. The bar clamp of claim 12 wherein the release lever and the engagement member are positioned at a side of the first housing portion in opposition to the trigger handle.

14. The bar clamp of claim 1 wherein the driving key and the locking key are formed at least on one longitudinal side with a lateral, open recess for engagement of a fixed catch projecting inwardly from a side wall of the housing.

15. The bar clamp of claim 1, and further comprising a fixed jaw carrier secured to the housing for supporting the first jaw, and a movable jaw carrier secured to the slide bar for supporting the second jaw; said movable jaw carrier being mounted to the slide bar by a connection selected from the group consisting of interlocking fit and interference fit.

16. The bar clamp of claim 15 wherein the slide bar is formed with a bore, said movable jaw carrier being provided with a detent for engagement in the bore.

17. The bar clamp of claim 15, and further comprising a fixed jaw carrier secured to the housing for supporting the first jaw, and a movable jaw carrier secured to the slide bar for supporting the second jaw, at least one of the jaw carriers including a resilient web for supporting the associated jaw.

18. The bar clamp of claim 1, and further comprising a fixed jaw carrier secured to the housing for supporting the first jaw and a movable jaw carrier secured to the slide bar for supporting the second jaw, said jaw carriers and the trigger handle being positioned at a same side with respect to the slide bar.

19. The bar clamp of claim 1 wherein the second support member is a pin for engagement in a bore of the second mounting plate of the trigger handle.

* * * * *